United States Patent [19]

Gundlach et al.

[11] 4,164,372

[45] Aug. 14, 1979

[54] METHOD AND APPARATUS FOR DEVELOPING AN ELECTRICAL IMAGE

[75] Inventors: Robert W. Gundlach, Victor, N.Y.; David H. Perry, deceased, late of Webster, N.Y., by Joyce Perry Province, administratrix

[73] Assignee: Xerox Corporation, Stamford, Conn.

[21] Appl. No.: 474,998

[22] Filed: May 31, 1974

[51] Int. Cl.[2] ..... G03G 15/00

[52] U.S. Cl. ..... 355/3 DD; 118/653; 427/25

[58] Field of Search ..... 355/3 R, 3 DD, 3 DR, 355/3 BE; 96/1 SD; 118/637, 638; 427/14, 25

[56] References Cited

U.S. PATENT DOCUMENTS

| | | | |
|---|---|---|---|
| 2,820,716 | 1/1958 | Harmon et al. | 427/25 |
| 3,232,190 | 2/1966 | Willmoth | 355/3 DD |

*Primary Examiner*—R. L. Moses
*Attorney, Agent, or Firm*—William A. Henry, II

[57] ABSTRACT

In xerography a positive charge image on the surface of a photoconductor is developed with a blade shaped conductor, and a non-conductive and flexible donor sheet having on one side a negatively charged toner layer. The donor sheet is mounted such that the layer is spaced from but near the surface of the photoconductor, and the conductor is mounted such that its edge slidably abuts the other side of the donor sheet in the region where the sheet is nearest the photoconductor. As a result, the part of the image nearest the edge establishes a non-uniform electrical field between the image and the edge. The non-uniform field is strongest in the region nearest the edge and causes the transfer of toner from the layer to the photoconductor. In one embodiment the donor sheet is in the form of a belt which is driven so that it slides over the edge. The photoconductor is placed on the surface of a rotatable drum and as the drum is rotated the image is developed. Means are provided for replenishing the toner used during development. In another embodiment the donor sheet and photoconductor are supported in parallel and the conductor is moved across said other side of the donor sheet to develop the image.

13 Claims, 2 Drawing Figures

METHOD AND APPARATUS FOR DEVELOPING AN ELECTRICAL IMAGE

Figure 1:
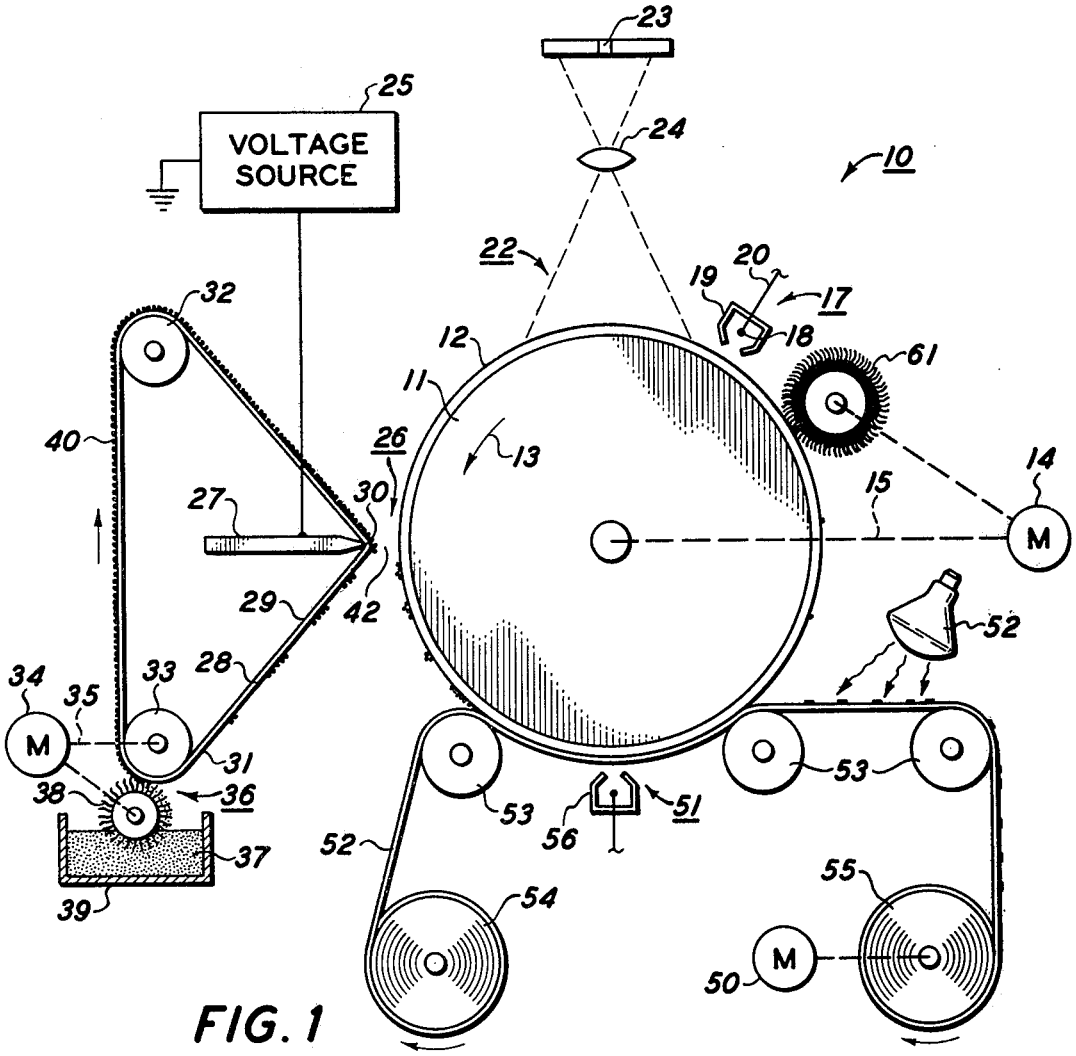

The subject invention relates to xerography and in particular to methods and apparatus for developing electrostatic images.

As is well known by persons skilled in the xerographic arts, modern processes for copying documents comprise the use of a photoconductor formed to define a continuous recording medium, such as a drum, which is moved with respect to a plurality of stations. At a first of such stations, the outer surface of the photoconductor is exposed to a corotron which uniformly charges the surface to a high positive potential. The positively charged surface of the photoconductor then moves past a second station where the light image of a master document being copied is projected on the surface. The light image modifies the charge distribution on the surface of the photoconductor such that the charge pattern corresponds to the visual information on the master document. At the next station, a negatively charged toner is uniformly applied to the surface of the photoconductor regardless of the fact that only some areas of the surface remain at a relatively high potential. Typically, in this step the toner is either dropped, cascaded over, or brushed onto the photoconductor. In theory, the negatively charged toner particles electrostatically adhere to those surface areas of the photoconductor which are at a relatively high potential to create a toner image corresponding to the master document. This toner image is then transferred to a suitable support, such as paper, and is fixed thereto to provide the copy of the master document. After the toner has been transferred the photoconductor moves to a cleaning station where any residual toner on the surface is removed in preparation for another cycle of operation.

While the above-described copying process is widely employed at the present time, it is subject to certain problems which limit its usefulness. For example, light areas on the original document cause substantial dissipation of the charge on corresponding areas of the photoconductor. However, some charge does remain on these areas of the photoconductor and when toner is applied some of the toner is retained in these areas. In addition, some toner is also retained due to simple contact forces not related to residual charge. Thus, when transfer of the toner on the photoconductor to a support takes place and is fixed, the resulting copy includes toner in areas which in the corresponding original document are completely light. Since the background of original documents is frequently light, the presence of toner in areas of the copy which should be free of toner adversely affects the overall appearance and quality of the copy.

A suggested remedy to this problem is set forth by R. W. Willmott in U.S. Pat. No. 3,232,190. Briefly, this patent shows a guide roll over the cylindrical surface of which one side of a flexible sheet is driven, the other side of the sheet being loaded with negatively charged toner. The guide roll is located such that the toner on the part of the sheet in contact with the roll is spaced from but adjacent to the surface of a rotatably mounted cylindrical photoconductor. According to the disclosure, an electrostatic image is provided on the photoconductor and when the photoconductor is rotated the image is brought into and out of proximity with the toner adjacent the surface of the guide roll. As the image moves past the guide roll toner particles on the part of the sheet against the roll are subjected to electrostatic forces. Since a gap exists between the photoconductor and the toner, only parts of the image having a high potential exert a force on the particles sufficient to attract them to the photoconductor. Thus, it is said that low potential areas of the image do not cause a transfer of toner and copies provided from this development of the image do not have toner in background areas. It is noted that in this arrangement the nearest parts of the guide roll and photoconductor are substantially parallel. Thus, if it is assumed that the guide roll is conductive, a charge on the photoconductor will provide a uniform electric field in the gap between the nearest parts of the guide roll and photoconductor for transferring toner particles. Unfortunately, toner particles having diameters of less than about 20 microns cannot be made to transfer in uniform fields across gaps exceeding 75 microns because the required fields exceed the critical stress for air ionization. Moreover, gaps of less than 75 microns are extremely difficult to maintain between moving parts and, therefore, the Willmott system is impractical when the use of fine toner (necessary for good resolution and sharp images) is desired.

It is an object of the present invention to provide an improved method and apparatus for transferring marking material through an air gap to a photoconductive member having an electrostatic latent image, thereby developing the image.

It is another object of the present invention to provide an improved xerographic method and apparatus, the apparatus being of the type wherein a photoconductive member bearing an electrostatic image is maintained in spaced relationship with a layer of marking material and particles from the layer are transferred through the space to develop the image, in which particles having an average diameter of less than 20 microns may be used to provide the layer of marking material.

Briefly, the invented method for developing an electrostatic latent image provided on a charged surface of a photoconductive member includes the steps of: (a) providing adjacent the image bearing surface a substantially non-conductive donor sheet bearing on the side facing the image a layer of releasably adhering electrostatically charged marking material, the layer of marking material being spaced from the image bearing surface; (b) placing an edge of a conductor against the other side of the donor sheet; (c) coupling the conductor to ground; and (d) moving the edge and the other side of the donor sheet with respect to each other, slidable contact being maintained between the edge and donor sheet. When the steps are executed, an electrical field is created between the image bearing surface and the conductor which drives marking material from the layer to the photoconductive member, thereby developing the latent image.

According to the invention, apparatus for developing an electrostatic latent image provided on a charged surface of a photoconductive member comprises: (a) a non-conductive donor sheet; (b) means for placing on one side of the donor sheet a layer of electrostatically charged marking material; (c) means for supporting the sheet with the layer of marking material spaced from but facing the image bearing surface; (d) a conductor having an edge; (e) means for electrically coupling the conductor to ground; (f) means for sliding the edge and the other side of the donor sheet with respect to each other; and (g) means for moving, during said sliding, the edge and the photoconductive member with respect to each other to bring different parts of the image bearing surface within a predetermined distance from the edge, the image bearing surface on the photoconductive member being kept out of contact with the layer of marking material on the donor. Operatively, during said sliding and relative motion the electrical field developed between the image bearing surface and the conductor drives marking material from the layer to the photoconductive member and the driven material develops the latent image.

Figure 2:
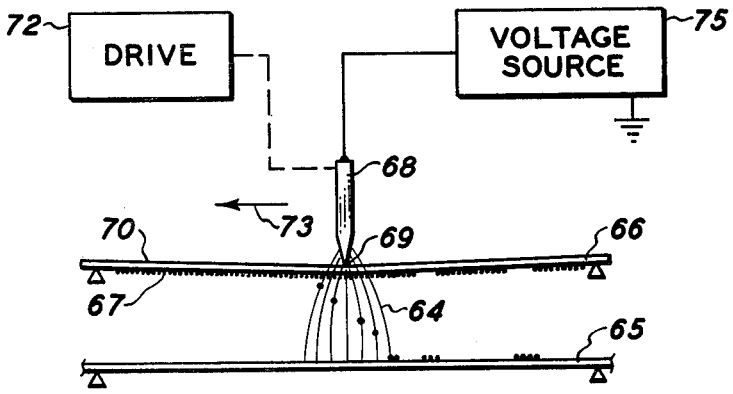

The above-mentioned and other objects and features of this invention will become apparent by reference to the following description in conjunction with the accompanying drawings, in which:

FIG. 1 is a schematic drawing of xerographic apparatus constructed in accordance with and embodying the teachings of the present invention; and FIG. 2 is a schematic drawing of a xerographic development arrangement constructed in accordance with and embodying the teachings of the present invention.

Referring to FIG. 1, one embodiment of xerographic apparatus 10, according to the invention, includes a photoconductive member 11 comprising, for example, an aluminum drum having on its outer cylindrical surface a layer of photoconductive material 12, such as selenium, with or without a protective outer coating. Member 11 is rotatably mounted and is driven in the direction of arrow 13 by a motor 14 which is mechanically connected to the member by a suitable mechanical coupling 15.

Disposed around the circumference of the continuous photoconductor member 12 are a plurality of spaced processing stations. In order of operation, the first of these stations is a charging station 17 comprising, for example, a corona discharge device. This device may include one or more fine corona generating wires 18 mounted within a shield 19 and connected by lead 20 to an appropriate high voltage corona discharge source, not shown. The wire is maintained at a corona generating potential (approximately 7,000 volts for selenium) with respect to shield 19 so that the photoconductor is charged to a uniform and relatively high potential.

The next station in the direction of rotation of the drum 11 is an exposure station 22. The exposure station shown comprises an exposure slit 23, and a lens 24 which is adapted to focus an image of a master document, not shown, appearing at slit 23 on the surface of the photoconductor. The areas of the photoconductor which receive the greatest amount of illumination, generally representing the lighter background of the document, are discharged to a greater extent than the areas of the photoconductor which are illuminated to a lesser extent. Thus, as the photoconductor 12 is rotated an electrostatic charge pattern is produced thereon.

Positioned next in the direction of rotation of the drum 11 is a developing station 26 to which the electrostatic image on the photoconductor is presented. This station is particularly important in accomplishing the objects of the present invention and comprises: a member having a sharp conductive edge, such as the blade shaped conductor 27; a non-conductive donor sheet 28 mounted so that a side 29 of the sheet is in contact with respect to the edge 30 of the conductor; means for sliding the donor sheet with respect to the edge of the conductor; and means for applying a layer of electrostatically charged layer of marking material to the other side 31 of the donor sheet. More specifically, in this embodiment the donor sheet is in belt form; and the means for sliding the sheet include an idler pulley 32 and a driven pulley 33 which cooperate with the edge 30 of the conductor to support the belt under tension. Pulley 33 is mechanically connected to a motor 34 by a suitable mechanical coupling 35. Thus, it may be seen that activation of the motor 34 causes the side 29 of the belt to slide against the edge 30 of conductor 27. Motor 34 may be of the variable speed type in which case the speed of the belt will be selectable. Alternatively, motor 34 can be dispensed with and pulley 33 can be connected mechanically (not shown) to the motor 14 to provide drive for the belt. As the belt is driven it passes a station 36 where marking material, such as toner 37, is transferred by a rotating brush 38 from a bin 39 to the side 31 of the belt. Toner 37 and brush 38 are selected, inter alia, so as to provide the belt with a triboelectrically charged layer of toner 40, the charge on the layer being opposite the charge on the surface of the photoconductor.

Conductor 27 is mounted such that its edge 30 is located at a predetermined distance from the surface of the photoconductor. Thus, a gap 42 exists between the edge 30 and the photoconductor 12, and the presence of charge on a photoconductive area opposite the edge of the conductor creates an electric field whose intensity in the gap is inversely proportional to the distance from the edge. Since the belt is driven over the edge and carries with it a layer of charged toner 40, the toner particles which make up the layer are subjected to the electrical field in the gap and if the field is strong enough toner particles are transferred to the surface of the photoconductive member 11, thereby developing the image on the photoconductor 12.

The force required to transfer a charged toner particle depends upon the cohesive forces between the particles in the layer 40. Therefore, to at least partially overcome the cohesive forces, the belt is arranged so that its direction of travel changes as it passes over the edge 30. This change in direction increases the spacing between adjacent toner particles of part of the layer in the gap and decreases cohesive forces, thereby decreasing the force required to remove toner particles from the layer. The magnitude of the force provided at the layer in the gap 42 by the photoconductor depends upon the thickness and dielectric constant of the belt. Accordingly, a thin belt is desired, due regard being given in its selection to the mechanical forces to which the belt is subjected. It is also desirable that the relaxation time constant of the belt be long compared with the time it takes for a small section of the belt to pass through the gap because migration of charge within the belt would, in time, neutralize electrostatic fields penetrating the belt. Therefore, a polyvinylfluoride film having a bulk resistivity of about $10^{13}$ ohm cm, such as is sold by E. I. duPont de Nemours & Co. under the trademark Tedlar, in thickness of less than 1 mil would be suitable for providing the belt.

The toner particles, which as is well known in the art are finely divided particles of pigmented resinous material, may have an average diameter which is in the 5 to 20 micron range and the toner layer may be in the 1 to 1.5 mil (25 to 35$\mu$) range. When these parameters are maintained the distance between the layer and the photoconductor may be in the 2 to 10 mils range and a charge on the photoconductor may be used to transfer toner particles without exceeding the breakdown voltage of the air in the gap.

Since the electrical field in the gap 42 must exceed a minimum value to attract toner particles to the photoconductive member 11, and since the toner layer 40 is not brought into physical contact with the photoconductive member, surface sections of the photoconductive member having little or no charge, corresponding to light areas on a master document, do not attract toner particles. Thus, when the toner on the member is transferred to paper or the like, as more fully described below, areas on the paper corresponding to light areas on the original document are substantially toner free. When the electrical field is greater than the minimum value but less than a maximum value which would deplete the belt of all toner carried into the gap 42, the amount of toner attracted to the member 11 is proportional to the strength of the electrical field. Thus, the apparatus is capable of providing pictorial copies. On way of controlling the density of such copies is by varying the potential to which corotron 17 charges the photoconductor 12, in which event conductor 27 should be connected directly to ground (not shown). Alternatively, density can be controlled by connecting the conductor 27 to a variable voltage source 25, said source providing a means for varying the potential between the edge 30 and the photoconductor 12.

Thus far, in the system described hereinabove it has been assumed that an original to be copied includes dark characters upon a light background and that the desired copy is to include dark characters against a light background. However, it frequently occurs, such as with microfilm images or cathode ray tube images, that an original includes light characters on a dark background and copies having dark characters on a light background are required. It should be noted that this can be achieved with the system disclosed by maintaining the conductive edge 30 at a potential matching that of the background areas (unexposed) of the latent image and using a toner having the same charge polarity.

After development the toner bearing part of the photoconductive member moves to a transfer station 51. At this station the toner image is transferred to a web 52 of paper or other suitable material which, in this example, is moved in a desired path by guide roll 53 from supply roll 54 to take up roll 55, roll 55 being driven by a motor 50. A corona discharge device 56 is positioned opposite the point of contact between the web 52 and the drum to aid in the transfer of the toner image to the web. The web is moved to a fixing station where the toner image is permanently affixed to the web. This may comprise an infrared radiating lamp 57 adapted to project sufficient heat on the surface of the web 52 to melt the toner thereon.

The last station in the operational cycle of the copy machine is a cleaning station 60 comprising a rotating brush 61 of suitable fibrous material. The brush is rotated by drive motor 14 and is adapted to remove any residual toner left on the photoconductor which was not transferred to the web 52 at the transfer station 51.

In a theoretical sense, it may be seen that in the development stage the aluminum drum carries the photoconductor past a cylindrical area opposite the edge of the conductor, the axis of such an area being parallel to the edge. Thus, in a process wherein paper coated with zinc oxide or the like is used as the photoconductive member (not shown), development of an electrostatic image on the paper may be achieved by passing the paper over a roller disposed adjacent a blade and belt arrangement such as is described above. Moreover, it should be noted that in the disclosed embodiment a fresh layer of toner is presented to the photoconductive member during the development process and that this is accomplished while the conductor is kept stationary. However, as described below, development of a stationary photoconductive member is possible.

Referring to FIG. 2, if a flatly supported photoconductive member 65, such as zinc oxide paper, is used in a xerographic process, development of a negative latent image on the member may be accomplished with apparatus comprising a flexible donor sheet supported in parallel with respect to member 65, the donor sheet 66 having a positively charged toner layer 67 on the side facing the member 65; and a blade shaped conductor 68 whose edge 69 abuts the other side 70 of donor sheet 66. With this arrangement as the conductor 68 is moved by the drive 72 in the direction indicated by arrow 73 toner particles under the edge 69 are attracted by the electrical field 64 created between the conductor 68 and the oppositely charged surface of the photoconductor 65. Since the donor sheet is flexible, as the conductor is moved the section of the donor sheet 66 under the edge 69 is stretched and the cohesive forces of the toner particles making up the layer are reduced, thereby reducing the electrostatic force required to transfer the toner onto the member 65. As with the embodiment shown in FIG. 1, the toner particles of layer 67 may have an average diameter in the 5 to 20 micron range, the layer 67 may be in the 1 to 1.5 mil range, and the distance between the layer 67 and photoconductor 65 may be in the 2 to 10 mil range. Further, conductor 68 may be grounded (not shown) or maintained at near ground potential by a voltage source 75.

It is to be understood that the description herein of preferred embodiments, according to the invention, is set forth as examples thereof and is not to be construed or interpreted as a limitation on the claims which follow and define the invention.

We claim:

1. Apparatus for developing an electrostatic latent image provided on a charged surface of a photoconductive member, comprising:

a non-conductive donor sheet;

a means for placing on one side of the donor sheet a layer of electrostatically charged marking material;

means for supporting the sheet with the layer of marking material spaced from but facing the image bearing surface;

a conductor having an edge;

means for electrically coupling the conductor to ground;

means for sliding the edge and the other side of the donor sheet with respect to each other; and means for moving, during said sliding, the edge and the photoconductive member with respect to each other to bring different parts of the image bearing surface within a predetermined distance from the edge, the image bearing surface of the photoconductive member being kept out of contact with the layer of marking material on the donor, whereby during said sliding and relative motion the electrical field developed between the image bearing surface and the conductor drives marking material from the layer to the photoconductive member and the driven material develops the latent image.

2. Apparatus as defined in claim 1 wherein the marking material is a finely divided powder composed of particles having an average diameter in the range of 5 to 20 microns.

3. Apparatus as defined in claim 2 wherein the finely divided powder is a pigmented resin.

4. Apparatus as defined in claim 1 wherein the predetermined distance is less than 14 mils.

5. Apparatus as defined in claim 4 wherein the donor thickness is less than 1 mil.

6. Apparatus as defined in claim 1 wherein the surface of the photoconductive member is substantially flat, and wherein the donor sheet is supported in parallel with the flat surface of the member.

7. Apparatus as defined in claim 6 wherein the donor sheet is flexible, and wherein said means for sliding the edge and the other side of the donor with respect to each other includes means for pressing the edge against the donor to distort the section of the donor in contact with the edge, thereby stretching the layer of marking material adjacent the distorted section of the donor.

8. Apparatus as defined in claim 7 wherein said means for coupling the conductor to ground includes a voltage source.

9. Apparatus as defined in claim 1 wherein the edge is spaced from a cylindrical area, the axis of the area and the edge being parallel; and wherein the photoconductive member is moved to pass the latent image through the area.

10. Apparatus as defined in claim 9 wherein the marking material is a finely divided powder composed of particles having an average diameter in the range of 5 to 20 microns.

11. Apparatus as defined in claim 10 wherein the predetermined distance is less than 14 mils and wherein the donor thickness is less than 1 mil.

12. Apparatus as defined in claim 9 wherein the donor sheet is a belt, further including means for replenishing marking material driven from the belt by the electrical field between the conductor and the electrostatic image.

13. Apparatus as defined in claim 1 wherein the charge on the surface of the photoconductive member is positive, wherein the marking material is positively charged, and wherein said means for electrically coupling the conductor to ground includes a voltage source for applying to the conductor a potential substantially matching the unexposed areas of the latent image.

* * * * *